US008646324B2

(12) United States Patent
Plonka et al.

(10) Patent No.: US 8,646,324 B2
(45) Date of Patent: Feb. 11, 2014

(54) METHOD AND DEVICE FOR DYNAMICALLY DIAGNOSING AN EXHAUST GAS PROBE

(75) Inventors: Peter Plonka, Remseck (DE); Alexander Bludau, Novi, MI (US); Benedikt Feldmann, Vaihingen/Enz (DE); Thomas Steinert, Weinstadt (DE); Wolfgang Mueller, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/389,760

(22) PCT Filed: Jul. 22, 2010

(86) PCT No.: PCT/EP2010/060634

§ 371 (c)(1),
(2), (4) Date: Apr. 27, 2012

(87) PCT Pub. No.: WO2011/018317

PCT Pub. Date: Feb. 17, 2011

(65) Prior Publication Data

US 2012/0222474 A1 Sep. 6, 2012

(30) Foreign Application Priority Data

Aug. 10, 2009 (DE) ..... 10 2009 028 367

(51) Int. Cl.
*G01M 15/10* (2006.01)

(52) U.S. Cl.
USPC ..... 73/114.69

(58) Field of Classification Search
USPC ..... 73/114.69
See application file for complete search history.

(56) References Cited

U.S. PATENT DOCUMENTS

| | | | | |
|---|---|---|---|---|
| 5,672,817 | A | 9/1997 | Sagisaka et al. | |
| 6,131,446 | A | 10/2000 | Schnaibel et al. | |
| 7,040,307 | B2 * | 5/2006 | Nagashima et al. | 123/688 |
| 8,087,291 | B2 * | 1/2012 | Michalske et al. | 73/114.69 |
| 8,145,409 | B2 * | 3/2012 | Kerns et al. | 701/109 |
| 8,210,034 | B2 * | 7/2012 | Nakamura | 73/114.73 |
| 2008/0053187 | A1 | 3/2008 | Koring | |
| 2010/0242569 | A1 * | 9/2010 | Kerns et al. | 73/1.06 |

FOREIGN PATENT DOCUMENTS

| | | | |
|---|---|---|---|
| DE | 102008006631 | 7/2009 | |
| EP | 1074718 | 2/2001 | |
| EP | 1074718 A2 * | 2/2001 | F02D 41/14 |

OTHER PUBLICATIONS

PCT/EP2010/060634 International Search Report dated Nov. 5, 2010 (3 pages).

* cited by examiner

*Primary Examiner* — Freddie Kirkland, III

(74) *Attorney, Agent, or Firm* — Michael Best & Friedrich LLP

(57) ABSTRACT

A method for dynamically diagnosing an exhaust gas probe. A target/actual comparison is performed between a calculated O2 signal and an O2 signal measured with the exhaust gas probe, for a step load transition. A device for dynamically diagnosing an exhaust gas probe disposed in an exhaust duct of an internal combustion engine. An output signal is fed to an engine controller connected to additional input signals providing information about intake air mass and fuel metering. The engine controller comprises devices for determining a calculated O2 signal from the information about the input air mass and the fuel metering and devices for filtering and/or gradient forming and/or integrating the calculated O2 signal and an O2 signal measured by the exhaust probe. A target/actual comparison between the calculated O2 signal and the measured O2 signal, can be performed for a step load transition.

18 Claims, 4 Drawing Sheets

METHOD AND DEVICE FOR DYNAMICALLY DIAGNOSING AN EXHAUST GAS PROBE

BACKGROUND OF THE INVENTION

The invention relates to a method for dynamically diagnosing an exhaust gas probe disposed in an exhaust duct of an internal combustion engine, wherein the dynamic diagnosis is performed after a change in a lambda value of the exhaust gas, and on the basis of a comparison of a measured signal rise relative to an expected rise of the signal.

The invention further relates to a device for dynamically diagnosing an exhaust gas probe disposed in an exhaust duct of an internal combustion engine, the output signal thereof being fed to an engine controller connected to additional input signals providing at least additional information about intake air mass and fuel metering.

The storage capacity of an emission control system for oxygen is utilized for the purpose of receiving oxygen during lean phases and in turn dispensing oxygen during rich phases. As a result, oxidizable constituents of harmful gas contained in the exhaust gas can be converted. An exhaust gas probe disposed downstream of the emission control system thereby serves to monitor the oxygen storage capacity of said emission control system. The oxygen storage capacity has to be monitored within the scope of the on-board diagnostics system because said capacity represents a measurement for the conversion capacity of said emission control system. In order to determine said oxygen storage capacity, either the emission control system is initially saturated with oxygen in a lean phase and is subsequently emptied in a rich phase having an exhaust gas of a known lambda ratio with regard to the amount of exhaust gas passing through said emission control system or said system is initially emptied of oxygen in a rich phase and in a lean phase is subsequently filled with an exhaust gas of a known lambda ratio with regard to the amount of exhaust gas passing through said system. The lean phase is ended if the exhaust gas probe downstream of said emission control system detects the oxygen, which can no longer be stored by said emission control system. A rich phase is likewise ended if said exhaust gas probe detects the passage of rich exhaust gas. An output signal of said exhaust gas probe furthermore serves as additional information for a lambda control, which however primarily is based on an output signal of a lambda probe disposed upstream of said emission control system.

If the exhaust gas probe has aged, the output signal of the exhaust gas probe slows down in its reaction to changes in the exhaust gas composition, and deviations can result in the diagnosis of the emission control system, which can lead to an emission control system, which is no longer operating correctly, being mistakenly determined to be in working order. Tremendous importance is thus attached to a dynamic monitoring of the exhaust gas probe.

The evaluation of the reaction speed of the exhaust gas probe to a changing $O_2$-concentration is understood by the term dynamic monitoring. Due to aging and contamination of the ceramic probe body, respectively the probe case, the possibility exists for the measurement of the $O_2$ concentration of the exhaust gas to be considerably delayed. For this reason, the functions relevant to emissions, which require the lambda signal as an input signal, would be operated in a delayed fashion. As a result, emission threshold values can be exceeded, which have been specified by the lawmakers (European authorities or CARB, EPA).

A method of prior art for diagnosing an emission control system also evaluates, for example, the ratio of the amplitudes of the output signals of the lambda probe disposed upstream of the emission control system and the lambda probe disposed downstream of said system. An emission control system in working order dampens the amplitude of an oscillation of the oxygen content of the exhaust gas at the outlet of the internal combustion engine so that the ratio of the amplitudes upstream and downstream of said emission control system results in a high value. A delayed reaction of the exhaust gas probe disposed downstream of said emission control system leads, however, likewise to a reduction in the amplitude of the output signal thereof, whereby the oxygen storage capacity of said emission control system is evaluated as too high. An emission control system, which no longer meets the legal requirements, can thus under certain circumstances be mistakenly classified as being in good working order.

A dynamic diagnosis is made difficult because of the fact that the output signal of the exhaust gas probe is dependent upon the initial and the final lambda value when a rich to lean or lean to rich step change occurs. In addition, the influence of the emission control system described above must be taken into consideration, wherein the influences of temperature and the age of said emission control system must additionally be considered.

A method for dynamically diagnosing an exhaust gas probe is stated in the German patent publication DE 19722334. The exhaust gas probe is disposed in the exhaust gas downstream of an emission control system. The rate of change of an output signal of the exhaust gas probe is used as the evaluation criterion, said rate of change occurring, for example, after the beginning of a phase in overrun conditions. A disadvantage thereby is that this method only works when a high mass air flow (>>50 kg/h) occurs. This is because the influence of the catalytic converter can only then be disregarded. In such operating states, undesired conditions can, however, arise when returning to load conditions after being in the overrun mode.

In the German patent publication DE 10 2006 041 477 A1, a method for dynamically diagnosing an exhaust gas probe disposed in the exhaust duct of an internal combustion engine downstream of the emission control system is described, wherein the dynamic diagnosis is performed at the same time that a step change in the lambda value of the exhaust gas from rich to lean or from lean to rich occurs.

The present-day operation of dynamic monitoring calculates two $O_2$ threshold values on the basis of the measured $O_2$ concentration during a valid step load transition. The measured rise time of the $O_2$ concentration from the first to the second threshold value is used as the evaluation criterion for the dynamic characteristics of the exhaust gas probe. If the measured rise time remains under a fixed threshold value, an intact message results, otherwise a fault is reported. The lambda signal is thereby qualified with respect to a fixed value in an operating range to be applied.

A disadvantage in this is that a setting of the operating range is dependent upon the component tolerances of the components upstream of the emission control system, including sensors and actuators. Possible drifting of the component characteristics is not taken into account with fixed threshold values. In addition, with these fixed threshold values, only a limited operating range for changes in load can be used for a dynamic diagnosis. Dynamic characteristics of the exhaust gas probe can also not always be correctly diagnosed with fixed threshold values. As a result, a dynamically defective exhaust gas probe can be evaluated as being in working order, which should be considered as critical in light of the massively increased or increasing legal requirements.

SUMMARY OF THE INVENTION

It is therefore the aim of the invention to provide a method for dynamically diagnosing an exhaust gas probe, which facilitates a greater and more reliable selectivity of the dynamic characteristics of the exhaust gas probe over an operating range and reduces the influence of the operating range on the release of a dynamic plausibility check by the probe output signal.

The aim relating to the method is thereby met by a target/actual comparison between a calculated $O_2$ signal and an $O_2$ signal measured by the exhaust gas probe, or between signals derived from said signals, being performed for a step load transition. Dynamic processes can be considered more reliably using the method than for the prior art, so that improved selectivity is made possible, independent of the operating point. The increased legal requirements with respect to the on-board diagnosis can thereby be fulfilled.

A preferred modification to the method thereby provides for the calculation of the $O_2$ signal to be performed with the air mass and the injected fuel quantity.

If the calculated $O_2$ signal and the measured $O_2$ signal are, for example, filtered by means of a low-pass filter and hence a calculated and filtered $O_2$ signal and a measured and filtered $O_2$ signal are formed for the target/actual comparison, the diagnostic result can be less affected by disturbances which temporarily occur during signal transmission or during signal processing.

If, as the invention provides in a preferred modification to the method, the gradients of the calculated $O_2$ signal and the measured $O_2$ or the gradients of the filtered $O_2$ signals are used for the target/actual comparison, particularly the dynamic characteristics of the exhaust gas probe can be directly analyzed. In comparison to a mere evaluation of the rise time between the aforementioned $O_2$ thresholds, said characteristics of the exhaust gas probe can also be reliably determined as a function of the respective operating condition. The assessment of this relative change is vis-B-vis an evaluation of an absolute change in the signal fundamentally less susceptible to disturbances with respect to possible offset influences within the evaluation system and the involved sensors or actuators.

It is particularly advantageous if a target value, which is associated with the respective operating point of the internal combustion engine, is formed for the target/actual comparison and is subsequently compared with the actual value. Within the scope of the application, a dynamic diagnosis is thus made possible not only in a limited operating range, as is the case up until now, but in a range which is now considerably expanded; thus enabling the dynamic characteristics of the exhaust gas probe to be determined in a broad operating range of the internal combustion engine. Secondly, dynamic diagnosis results from different operating ranges can also be used for the assessment in order, for example, to check the individual results for plausibility or also to identify the operating conditions, in which a dynamic diagnosis should not take place. Should, for example, there turn out to be a defect in the dynamics of the exhaust gas probe, a dynamic protraction of the signal will not only appear for a step load transition in the present operating range but is detectable for step load changes in other operating ranges.

In a preferred modification to the method, the invention provides for a first and a second $O_2$ threshold value of the calculated $O_2$ signal to be determined for the step load transition on the basis of the signal curve of the calculated and filtered $O_2$ signal. Provision is thereby made for the threshold value determination of the $O_2$ threshold values to be performed again for each step load transition used for the dynamic diagnosis. A modification to the method furthermore provides that in the case of a valid step load transition, an $O_2$ threshold value of the measured $O_2$ signal is determined based on the measured $O_2$ signal, the calculation thereof being performed identically to the calculation of the first $O_2$ threshold value of the calculated $O_2$ signal. In so doing, a percentagely identical threshold value is taken as a basis with regard to the respective signal deviation.

This respective recalculation of the $O_2$ threshold values means on the one hand that the $O_2$ threshold values can be adapted in each case to the operating range, in which the dynamic diagnosis takes place. On the other hand, an improved diagnosis can be achieved with these variable $O_2$ threshold values in comparison to the rigidly predefined threshold values according to prior art in the event of a drift of the component characteristics. Furthermore, the influence of the vehicle driver, which stems from releasing the gas pedal differently in each case, can, for example, be avoided. This relates particularly to the compensation for the quantity gradient during a transition to overrun conditions.

For the dynamic diagnosis of an exhaust gas probe, a preferred modification to the method provides that for the calculated $O_2$ signal or for the calculated and filtered $O_2$ signal during the time of reaching the first $O_2$ threshold value of said calculated $O_2$ signal up until reaching the second $O_2$ threshold value of said calculated $O_2$ signal, an $O_2$ gradient signal for the calculated value is integrated and the target value is derived from the result thereof. In addition, an integration period can be determined for said calculated $O_2$ signal. Parallel to this, an $O_2$ gradient signal for the measured value is integrated for the measured $O_2$ signal or for the calculated and filtered $O_2$ signal and the actual value is derived from the result of this integration. The integration period for the calculated $O_2$ signal is thereby used as the integration period for the measured $O_2$ signal. A trigger time is used as the starting point in time of the integration, said trigger time being determined if the measured $O_2$ signal or the measured and filtered $O_2$ signal exceeds the $O_2$ threshold value of the measured $O_2$ signal. The integrals calculated in this manner for the target value and the actual value particularly take into account the dynamic effects and are additionally robust against offsets and temporary signal disturbances.

The actual value and the target value can then be set in relationship to one another for the dynamic diagnosis, and a dynamic assessment of the exhaust gas probe can be derived from the result of this relationship, wherein the integral for the actual value becomes smaller in relation to the integral for the target value with worsening dynamics.

In an equally advantageous modification to the method, provision can be made for the dynamic assessment to be performed by direct comparison between the absolute $O_2$ gradient signal for the calculated value and the absolute $O_2$ gradient signal for the measured value. Provision can, for example, likewise be made for the dynamic assessment to be performed by direct comparison of the temporal profiles of the calculated $O_2$ signal and the measured $O_2$ signal or of the temporal profiles of the filtered $O_2$ signals. Both modifications also meet the requirements for a reproducible selectivity of the dynamic monitoring, are, however, less complex and therefore can be used in simplified OBD units.

The aim relating to the device is thereby met in that the engine controller comprises devices for determining a calculated $O_2$ signal from the information about the input air mass, for example, ascertained by evaluation of the signals of an air mass flow meter or by means of a model, and the fuel metering and also comprises devices for filtering and/or gradient forming and/or integrating the calculated $O_2$ signal and an $O_2$ signal measured by the exhaust probe, wherein for the purpose of a dynamic diagnosis a target/actual comparison between said calculated $O_2$ signal and said $O_2$ signal measured by the exhaust probe, or between signals derived from said signals, can be performed for a step load transition. The devices required for performing the method as, for example, low-pass filter units, differentiation units, integration units and units for calculating threshold values can thereby be implemented as a hardware or software solution within the higher-ranking engine controller and consequently form an important functional group within an on-board diagnostic device. Moreover, separate diagnostic devices are conceivable, which can communicate with the higher-ranking engine controller.

BRIEF DESCRIPTION OF THE DRAWINGS

The invention is explained in detail below with the aid of an exemplary embodiment depicted in the figures. The following are shown.

DETAILED DESCRIPTION

Figure 1:
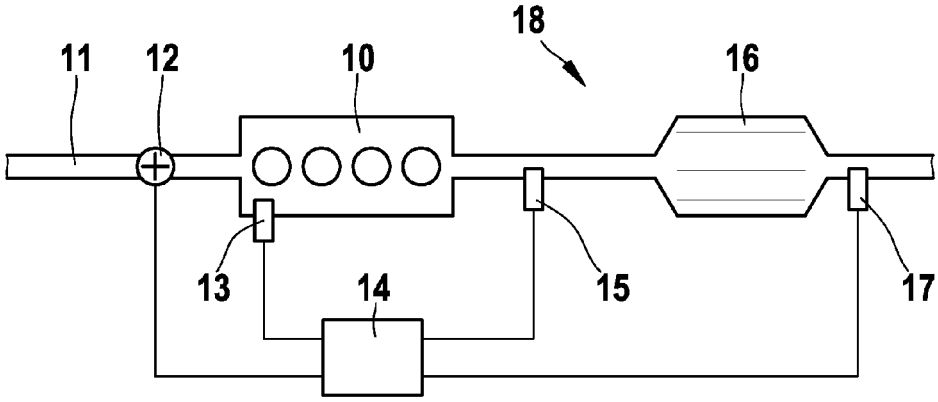
FIG. 1 the technical environment in schematic depiction, in which the inventive method can be used, FIG. 2 a fundamental time flow-chart for different signal values of an exhaust gas probe during a dynamic diagnosis, FIG. 3 exemplarily depicted: the processing of the signal values of a new exhaust gas probe, FIG. 4 exemplarily depicted: the processing of the signal values of an aged, sluggish exhaust gas probe, FIG. 5 the fundamental procedural approach for calculating $O_2$ threshold values, FIG. 6 the fundamental procedural approach for the integration of the $O_2$ gradient signal of a new exhaust gas probe and FIG. 7 the fundamental procedural approach for the integration of the $O_2$ gradient signal of an aged, sluggish exhaust gas probe.

FIG. 1 shows schematically by way of example the technical environment, in which the method according to the invention for dynamically diagnosing an exhaust gas probe 17 can be used. Air is supplied to an internal combustion engine 10 via an air duct 11 and the mass thereof is measured by an air mass flow meter 12. The air mass flow meter 12 can be embodied as a hot-film air mass flow meter. The exhaust gas of the internal combustion engine 10 is discharged via an exhaust duct 18, wherein an emission control system 16 is provided in the direction of flow of the exhaust gas downstream of said internal combustion engine 10. An engine controller 14 is provided for controlling the internal combustion engine 10, said engine controller on the one hand delivering fuel to said internal combustion engine 10 via a fuel metering device 13 and on the other hand being provided with the signals of the air mass flow meter 12 and a lambda probe 15, which is disposed in the exhaust duct 18, as well as signals of an exhaust gas probe 17 disposed in said exhaust duct 18. The lambda probe 15 measures a lambda actual value of a fuel/air mixture supplied to said internal combustion engine 10. Said probe can be embodied as a wideband lambda sensor. The exhaust gas probe 17 measures the exhaust gas composition downstream of the emission control system 16. Said exhaust gas probe 17 can be embodied as a step change sensor.

The method according to the invention is disclosed using the time flow-charts 20 depicted in FIGS. 2 to 7, in which a profile of different signal values 21 of the exhaust gas probe 17 or of signals derived therefrom are shown versus a time axis 24 for a step load transition. The time flow-charts 20 exemplarily show that initially starting from a rich phase 22 and the exhaust gas composition changing as a result of the step load transition, lean exhaust gas having an increased $O_2$ concentration reaches said exhaust gas probe 17. Vis-B-vis the rich phase 22, this temporal range is referred to as the lean phase 23. Other transitions could correspondingly be used for the dynamic diagnosis, in which the lambda value of said exhaust gas probe 17 changes.

Figure 2:
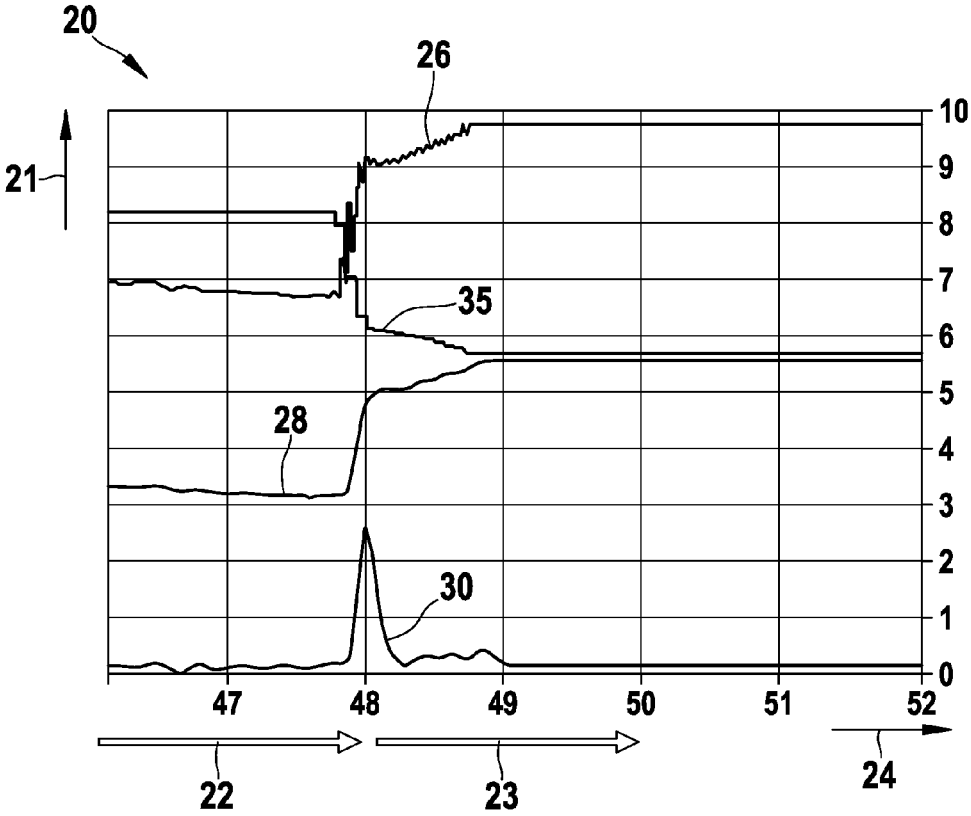

FIG. 2 shows the temporal profile of a calculated $O_2$ signal 26, which is based on the fuel participating in the combustion of the internal combustion engine 10 as well as on the air-oxygen ascertained. Both signals can be derived from the signals of the air mass flow meter 12 and the fuel metering device 13 of FIG. 1. In the example shown, this signal rises when a step load transition occurs. At the same time, an injected fuel quantity 35, which is specified by the fuel metering device 13, is reduced. In addition to the profile of the calculated $O_2$ signal 26, the profile of a calculated and filtered $O_2$ signal 28 is depicted, which in comparison to the unfiltered calculated $O_2$ signal 26 no longer has temporary fluctuations or considerably reduces said fluctuations. Building on this, an $O_2$ gradient profile 30 is determined for the calculated $O_2$ signal 26.

Figure 3:
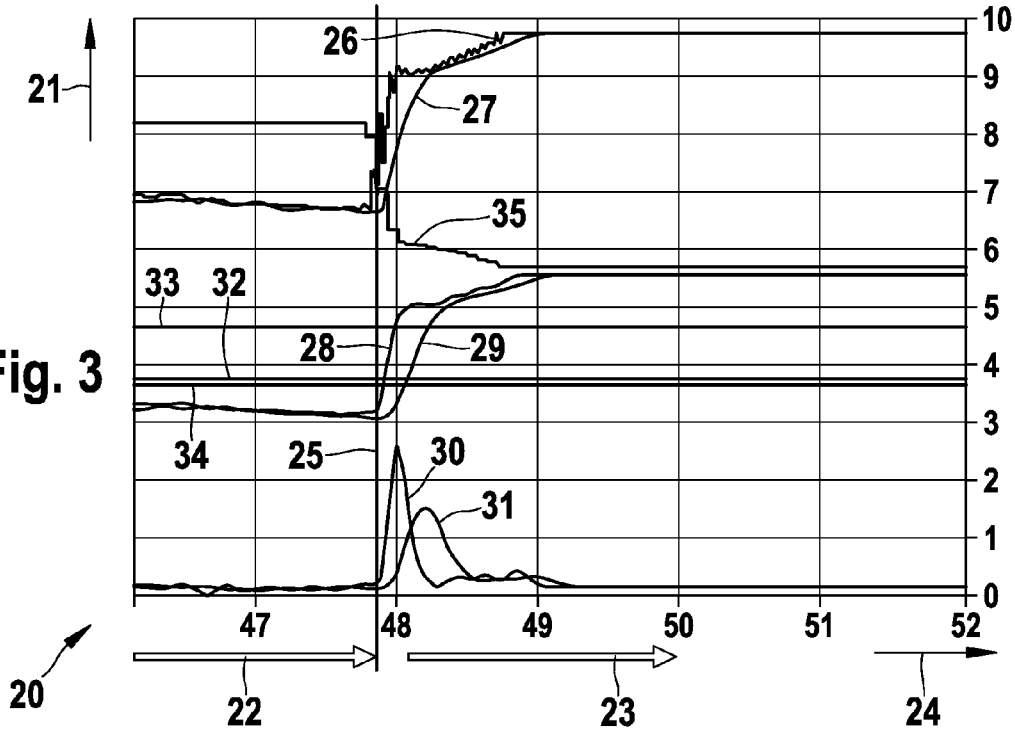
Figure 4:
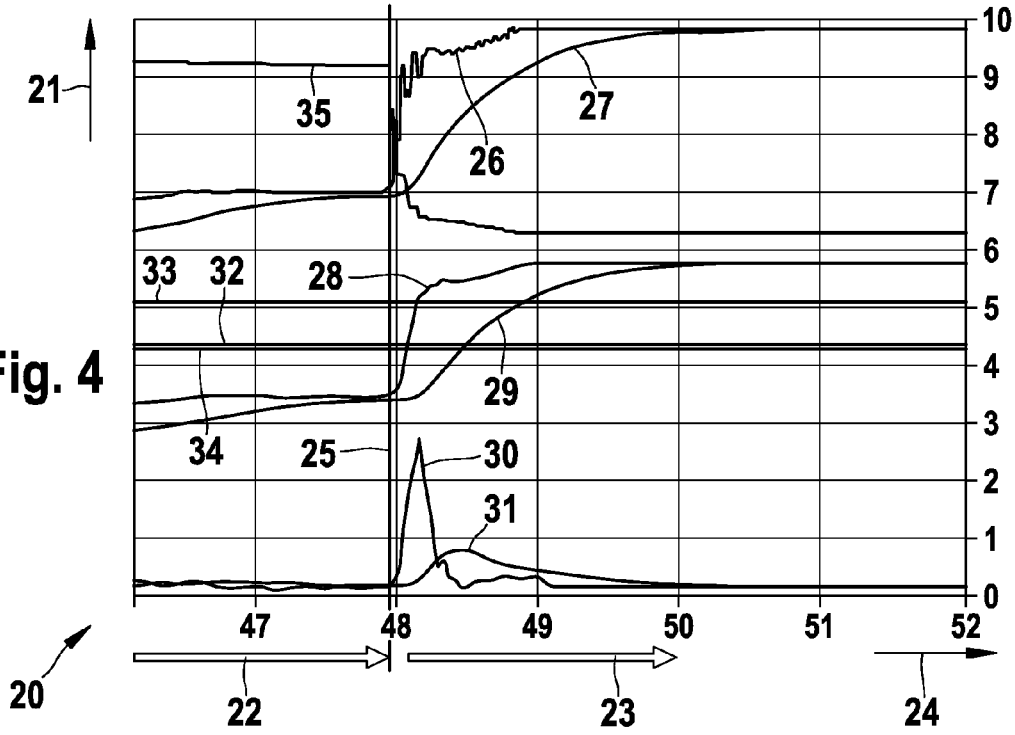

In FIGS. 3 and 4, the further signal processing for the dynamic diagnosis of a new exhaust gas probe 17 (FIG. 3) and for an aged, sluggish exhaust gas probe 17 are exemplarily shown.

If a step load transition occurs, a first $O_2$ threshold value of the calculated $O_2$ signal 32 as well as a second $O_2$ threshold value of the calculated $O_2$ signal 33 is determined on the basis of the calculated and filtered $O_2$ signal 28. Parallel to this process, an $O_2$ signal 27 measured by the exhaust gas probe 17 is converted into a measured and filtered $O_2$ signal 29, the profile of which is likewise depicted here. From the measured and filtered $O_2$ signal 29 and the calculated and filtered $O_2$ signal 28, an $O_2$ gradient signal 30, 31 is determined in each case for the calculated value and the measured value. In the case of a valid step load transition, an $O_2$ threshold value of the measured $O_2$ signal 34 is generated on the basis of the measured $O_2$ signal 27. The calculation thereof is thereby identical to the calculation of the first $O_2$ threshold value of the calculated $O_2$ signal 32. A point in time of the threshold value calculation 25 can thereby be determined by the signal rise of the calculated $O_2$ signal 26.

As can be seen, the profiles of the various signal values 21 in FIG. 3 and FIG. 4 are very different and can already be used for dynamically diagnosing the exhaust gas probe 17. A comparison of the calculated and the measured $O_2$ signal 26, 27 shows, for example, that in the case of a new exhaust gas probe 17 (FIG. 3), the profile of the measured $O_2$ signal 27 follows the profile of the calculated $O_2$ signal 26 relatively closely. In contrast, the rise in the measured $O_2$ signal 27 of an aged, sluggish exhaust gas probe 17 (FIG. 4) begins in a delayed manner, said rise being smaller than that of the profile of the calculated $O_2$ signal 26 due to the sluggishness. A similar behavior can be seen when comparing the filtered $O_2$ signals 28, 29. The $O_2$ gradient signals 30, 31 for the calculated and the measured $O_2$ signal 26, 27 show the difference even more markedly. The absolute height of the $O_2$ gradient signal 31 for an aged, sluggish exhaust gas probe 17 is considerably lower than is the case for a new exhaust gas probe 17.

Figure 5:
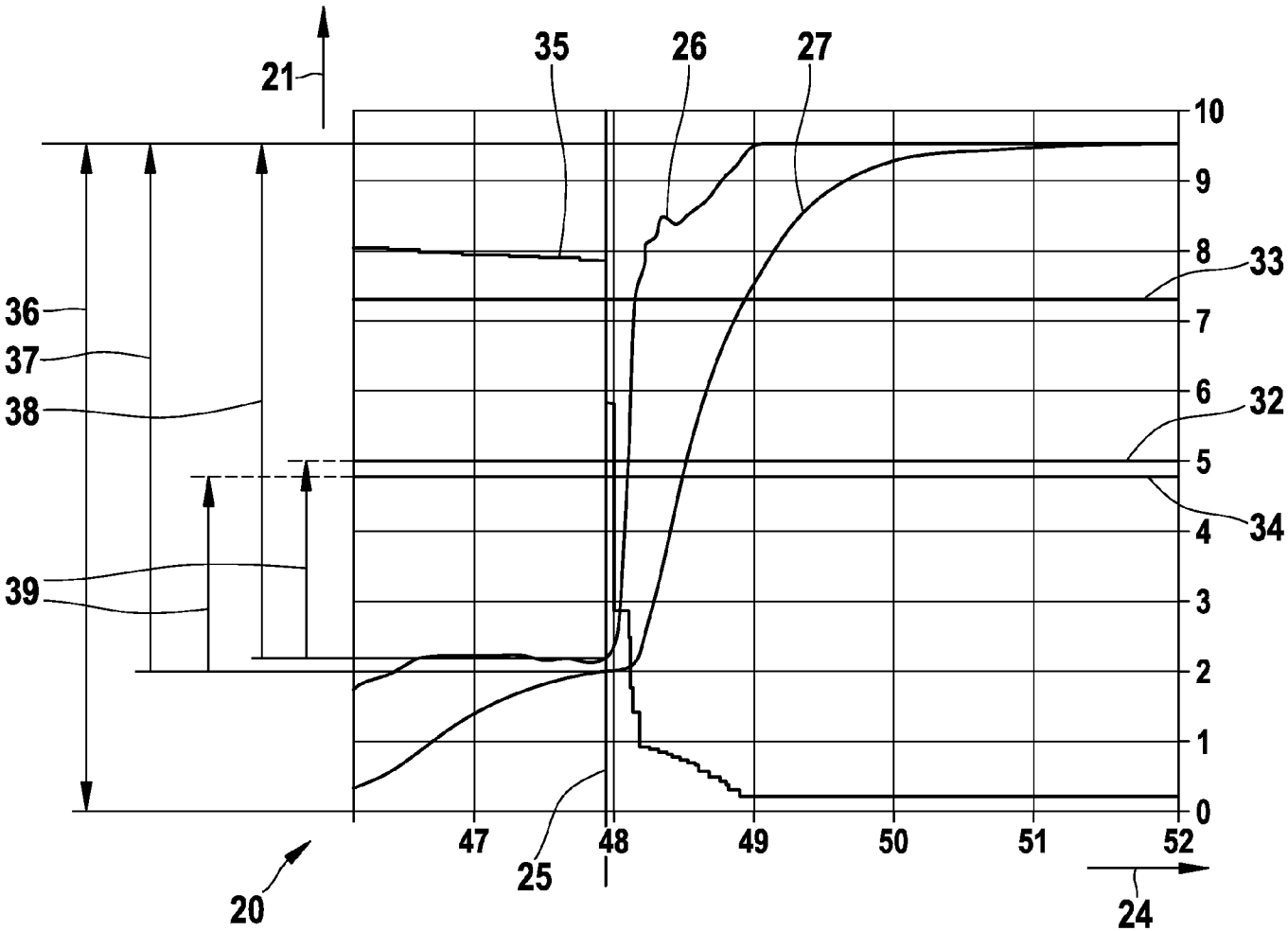

The fundamental procedural approach for calculating the $O_2$ threshold values 32, 33, 34 is illustrated in FIG. 5. In the saturated range, i.e. long after the step load transition, the absolute value of the calculated and the measured $O_2$ signal 26, 27 with respect to the zero baseline corresponds to an $O_2$ concentration of the ambient air 36, which with 21.95% can be assumed to be almost constant. This value, which can be set against the signal deviations of the calculated and the measured $O_2$ signal 37, 38, can serve to standardize the absolute signal values 21.

Based on the signal deviation of the calculated $O_2$ signal 38, a percentage threshold value 39 for the first $O_2$ threshold value of the calculated $O_2$ signal 32 is predefined. The second $O_2$ threshold value of the calculated $O_2$ signal 33 is correspondingly also predefined, the percentage threshold value 39 being thereby different from the first. The determination of the $O_2$ threshold value of the measured $O_2$ signal 34 is performed correspondingly. In so doing, the same percentage threshold value 39 is taken as a basis as was used in determining the first $O_2$ threshold value of the calculated $O_2$ signal 32.

The point in time of the threshold calculation 25 is predefined in the example shown from the beginning of the drop in the injected fuel quantity 35.

Figure 6:
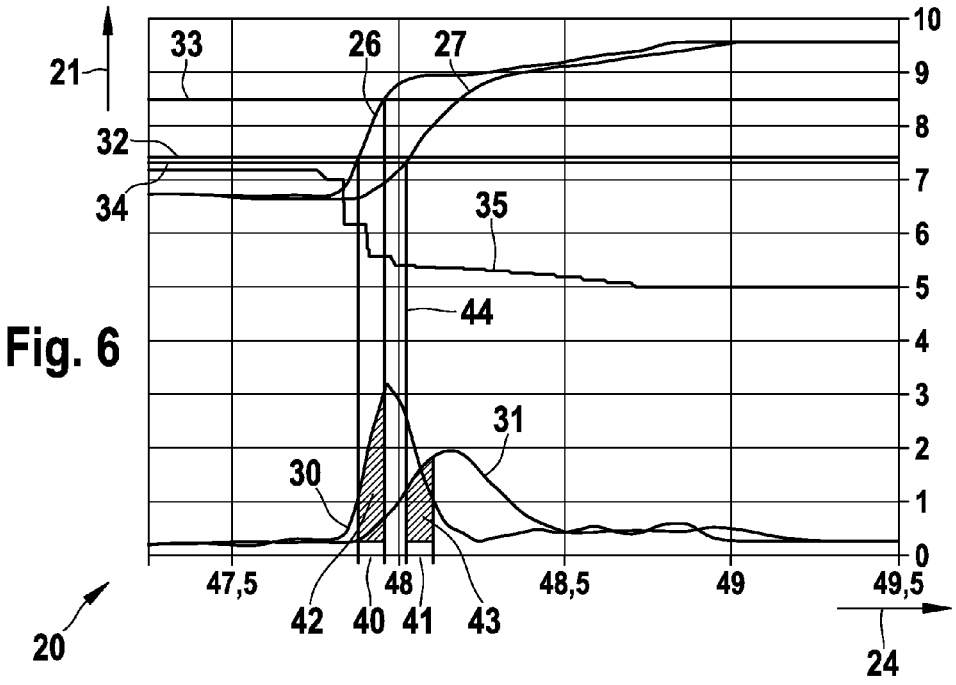
Figure 7:
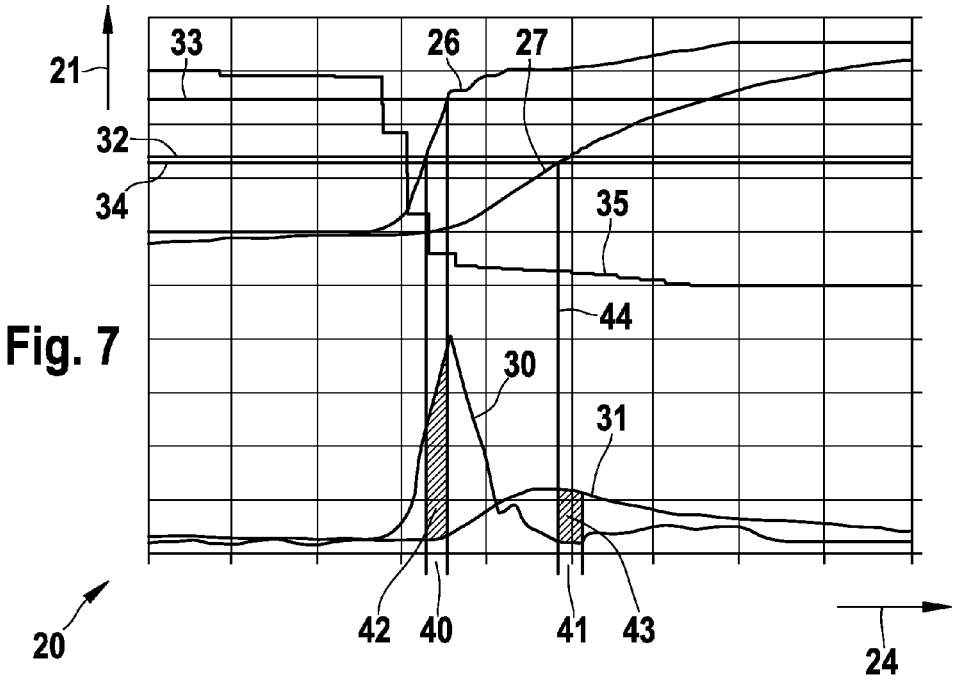

FIGS. 6 and 7 show the evaluation procedure of a preferred modification to the method, wherein the evaluation of a new exhaust gas probe 17 is shown in FIG. 6 and the evaluation of an old, sluggish exhaust gas probe 17 is shown in FIG. 7.

When performing the dynamic diagnosis, the invention provides in both figures that for the calculated $O_2$ signal 26 during the time from reaching the first $O_2$ threshold value of the calculated $O_2$ signal 32 up until reaching the second $O_2$ threshold value of the calculated $O_2$ signal 33, the $O_2$ gradient signal 30 for the calculated value is integrated and that a target value 42 is derived from the result of the integral formation. In addition, an integration period can be determined for the calculated $O_2$ signal 40. Parallel to this, with regard to the measured $O_2$ signal 27, the $O_2$ gradient signal 31 for the measured value is integrated and an actual value 43 is derived from the result thereof. The integration period for the calculated $O_2$ signal 40 is thereby used as the integration period for the measured $O_2$ signal 41. A trigger time 44 is used as the starting point in time of the integration of the $O_2$ gradient signal 31 for the measured value, said trigger time being determined if the measured $O_2$ signal 27 exceeds the $O_2$ threshold value of the measured $O_2$ signal 34. The integrals calculated in this manner for the target value 42 and the actual value 43 can now be used for the quantitative dynamic diagnosis. The ratios of the target and actual values 42, 43 derived from the integrals can assume different values depending upon the sluggishness of the exhaust gas probe 17 and can be used directly as a measurement for the dynamics of said exhaust gas probe 17. The area ratio of the two areas for the target and the actual value 42, 43 in FIG. 7 is, for example, relatively small with respect to the area ratio in FIG. 6.

In a modification to the method, which is not depicted, the respective filtered $O_2$ signals 28, 29 can be evaluated as described above.

In comparison to prior art, the method according to the invention allows a dynamic diagnosis having greater selectivity to be performed, independent of the operating point. The increased legal requirements with respect to on-board diagnosis can thereby be fulfilled.

The invention claimed is:

1. A method for dynamically diagnosing an exhaust gas probe (17) disposed in an exhaust duct (18) of an internal combustion engine (10), wherein the dynamic diagnosis is performed after a change in a lambda value of the exhaust gas and on the basis of a comparison of a measured signal rise relative to an expected rise of the signal, characterized in that a target/actual comparison is performed between a calculated $O_2$ signal (26) which forms a target value and a measured $O_2$ signal (27) which forms an actual value and is measured by the exhaust gas probe (17), or between signals derived from these signals, wherein, for the target/actual value comparison, a target value (42) which is assigned to the respective operating point of the internal combustion engine (10) is formed on an individual basis and subsequently compared with the actual value (43), and wherein on the basis of the target/actual value comparison a dynamic assessment of the exhaust gas probe takes place, characterized in that the target/actual value comparison is carried out at a step load transition, in that the calculated $O_2$ signal (26) and the measured $O_2$ signal (27) are filtered for the target/actual value comparison and a calculated and filtered $O_2$ signal (28) and a measured and filtered $O_2$ signal (29) are formed therefrom, and in that $O_2$ gradient signals (30, 31) of the calculated $O_2$ signal (26) and of the measured $O_2$ signal (27) or of the filtered $O_2$ signals (28, 29) are determined and used for the target/actual value comparison.

2. The method according to claim 1, characterized in that the calculated $O_2$ signal (26) is calculated from an air mass and an injected fuel quantity.

3. The method according to claim 1, characterized in that at the step load transition a first and a second $O_2$ threshold value of the calculated $O_2$ signal (32, 33) are determined on the basis of the signal profile of the calculated and filtered $O_2$ signal (28).

4. The method according to claim 3, characterized in that the $O_2$ threshold values (32, 33, 34) is determined again for each step load transition used for the dynamic diagnosis.

5. The method according to claim 1, characterized in that in the event of a valid step load transition, the $O_2$ threshold value of the measured $O_2$ signal (34) is determined on the basis of the measured $O_2$ signal (27), wherein the calculation thereof is carried out identically to the calculation of the first $O_2$ threshold value of the calculated $O_2$ signal (32).

6. The method according to claim 1, characterized in that for the calculated $O_2$ signal (26) during the time from reaching the first $O_2$ threshold value of the calculated $O_2$ signal (32) up until reaching the second $O_2$ threshold value of the calculated $O_2$ signal (33), an $O_2$ gradient signal (30) for the calculated value is integrated and the target value (42) is derived from the result thereof.

7. The method according to claim 6, characterized in that an integration period is additionally determined for the calculated $O_2$ signal (40).

8. The method according to claim 7, characterized in that for the measured $O_2$ signal (27) or for the calculated and filtered $O_2$ signal (29), the $O_2$ gradient signal (31) for the measured value is integrated and the actual value (43) is derived from the result thereof, wherein the integration period for the calculated $O_2$ signal (40) is used as the integration period of the measured $O_2$ signal (41) and a trigger time (44) is used as the starting point in time of the integration, said trigger time (44) being determined if the measured $O_2$ signal (29) or the measured and filtered $O_2$ signal (28) exceeds the $O_2$ threshold value of the measured $O_2$ signal (34).

9. The method according to claim 1, characterized in that the actual value (43) and the target value (42) are placed in a ratio with respect to one another for the dynamic diagnosis, and the dynamic assessment of the exhaust gas probe (17) is derived from the result.

10. The method according to claim 1, characterized in that the dynamic assessment is performed by direct comparison between the absolute $O_2$ gradient signal (30) for the calculated value and the absolute $O_2$ gradient signal (31) for the measured value.

11. The method according to claim 1, characterized in that the dynamic assessment is performed by direct comparison of the temporal profiles of the calculated $O_2$ signal (26) and the measured $O_2$ signal (27) or the temporal profiles of the filtered $O_2$ signals (28, 29).

12. The method according to claim 1, characterized in that the target/actual comparison is between signals derived from the calculated $O_2$ signal (26) and the $O_2$ signal (27) measured by the exhaust gas probe (17).

13. The method according to claim 1, characterized in that for the calculated and filtered $O_2$ signal (28) during the time from reaching the first $O_2$ threshold value of the calculated $O_2$ signal (32) up until reaching the second $O_2$ threshold value of the calculated $O_2$ signal (33), an $O_2$ gradient signal (30) for the calculated value is integrated and the target value (42) is derived from the result thereof.

14. A device for dynamically diagnosing an exhaust gas probe (17) disposed in an exhaust duct (18) of an internal combustion engine (10), the output signal thereof being fed to an engine controller (14) connected to additional input signals providing at least information about intake air mass and fuel metering device (13), characterized in that the engine controller (14) comprises devices for determining a calculated $O_2$ signal (27) from the information about the input air mass and the fuel metering device (13) and devices for filtering and for forming gradient signals (30, 31) of the calculated $O_2$ signal (26) and an $O_2$ signal (27) measured by the exhaust probe (17), wherein for the purpose of a dynamic diagnosis, a target/actual comparison between the $O_2$ gradient signals (30, 31) of the calculated $O_2$ signal (26) and the $O_2$ signal (27) measured by the exhaust probe can be performed for a step load transition.

15. The device according to claim 14, characterized in that the input air mass can be determined by means of an air mass flow meter (12) or by a model.

16. The device according to claim 14, characterized in that the devices for modifying the signals include devices for filtering, gradient forming, and integrating the signals.

17. The device according to claim 14, characterized in that the devices for modifying the signals include devices for at least one of filtering, gradient forming, and integrating the signals.

18. The device according to claim 14, characterized in that a device for integrating the gradient signals (30, 31) is present and the engine controller is designed to assess the dynamics of the exhaust gas probe (17) on the basis of the integrated gradient signals (30, 31).

* * * * *

UNITED STATES PATENT AND TRADEMARK OFFICE

CERTIFICATE OF CORRECTION

PATENT NO. : 8,646,324 B2
APPLICATION NO. : 13/389760
DATED : February 11, 2014
INVENTOR(S) : Plonka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 69 days.

Signed and Sealed this
Twenty-ninth Day of September, 2015

Michelle K. Lee

Michelle K. Lee
*Director of the United States Patent and Trademark Office*